US005617736A

United States Patent [19]

Ito et al.

[11] Patent Number: 5,617,736

[45] Date of Patent: Apr. 8, 1997

[54] BEVERAGE COOLING AND DISPENSING MACHINE

[75] Inventors: Sukehide Ito, Numazu; Eiichi Kurokawa, Mishima; Akira Morishita, Numazu, all of Japan

[73] Assignee: Toshiba Machine Co., Ltd., Tokyo, Japan

[21] Appl. No.: 590,196

[22] Filed: Jan. 23, 1996

[30] Foreign Application Priority Data

Jan. 23, 1995 [JP] Japan ..... 7-007946

[51] Int. Cl.[6] ..... B67D 5/62

[52] U.S. Cl. ..... 62/393; 222/146.6

[58] Field of Search ..... 62/389, 392, 393; 222/146.6

[56] References Cited

U.S. PATENT DOCUMENTS

| | | | |
|---|---|---|---|
| 1,663,683 | 3/1928 | Doughty | 62/392 |
| 3,036,820 | 5/1962 | Berwick et al. | 62/392 |
| 4,674,656 | 6/1987 | Wiley et al. | 222/129.1 |

FOREIGN PATENT DOCUMENTS

| | | |
|---|---|---|
| 6-293392 | 10/1994 | Japan . |
| 6-300413 | 10/1994 | Japan . |

*Primary Examiner*—William Doerrler
*Attorney, Agent, or Firm*—Cushman Darby & Cushman, IP Group of Pillsbury Madison & Sutro, LLP

[57] ABSTRACT

A beverage cooling and dispensing machine allows easy attachment and detachment of elements such as a cooling pipe. The beverage cooling and dispensing machine comprises a cooling water tank storing cooling water and including an evaporator, a refrigerator for supplying a coolant to the evaporator, a cooling pipe through which beverage flows, the cooling pipe being formed as a coil and placed within the cooling water tank, a dispensing head attached to a mouth of a beverage tank filled with beverage, a hose one end of which is connected to the dispensing head, and the other end of which is connected to an end of the cooling pipe on a beverage introducing side, a spigot connected to the end of the cooling pipe on the beverage introducing side, and an agitator, placed within the coil of the cooling pipe, for stirring the cooling water. The dispensing head, the hose, the cooling pipe and the spigot are integrated as one unit constituting a beverage pouring unit, which is detachably attached to the cooling water tank. The agitator is supported by supporting legs fixed to a bottom of the cooling water tank.

2 Claims, 5 Drawing Sheets

BEVERAGE COOLING AND DISPENSING MACHINE

BACKGROUND OF THE INVENTION

1. Field of the Invention

The present invention relates to a beverage cooling and dispensing machine for cooling and dispensing beverage such as draft beer.

2. Description of the Related Art

A machine as shown in FIG. 3 is known as a type of conventional beverage cooling and dispensing machine. A cooling water tank 1 stores cooling water 2. One end of a cooling pipe 3 for beverage, arranged in the cooling water tank 1, is connected to a spigot 5, serving as a beverage pourer, through heat insulating material 4 which forms a wall of the water tank. The other end of the cooling pipe 3 is connected to a hose 6 outside the cooling water tank 1 also through the heat insulating material 4. A dispensing head 8 of a beverage tank 7 is connected to an upstream end of the hose 6.

An evaporator 10 connected to a refrigerator 9 is arranged in the cooling water tank 1. The cooling water 2 is cooled by operating the refrigerator 9. Part of the cooling water 2 is frozen and a substantially constant amount of ice is stored in a peripheral portion of the evaporator 10. An agitator 12 is provided within the cooling water tank 1. The cooling water 2 is stirred by the agitator 12, so that beverage flowing through the cooling pipe 3 can be efficiently cooled.

When the spigot 5 is opened, beverage 300 in the beverage tank 7 is caused to flow through a inductor tube (not shown) in the beverage tank, the dispensing head 8, the hose 6 and the cooling pipe 3 in this order, and poured out through the spigot 5 by a pressure of carbon dioxide gas supplied from a carbon dioxide gas cylinder. The beverage 300 is cooled, while it is flowing through the cooling pipe 3 by heat exchange with the cooling water 2 around the pipe. In FIG. 3, a reference numeral 16 denotes an upper cover of the cooling water tank 1.

In the machine of the type as described above, the dispensing head 8 is attached to the mouth of the beverage tank 7, before the beverage 300 is taken out of the beverage tank 7. During the attachment, the mouth of the beverage tank 7 and the interior of the dispensing head 8 are brought into contact with the air and bacteria are brought into contact with the beverage, the bacteria may enter the hose 6, the cooling pipe 3 or the spigot 5 and breed there. Particularly in a case of nutritious beverage, such as beer, the beverage may be considerably spoiled.

Especially in summer, since the atmospheric temperature is high, the temperature of the dispensing head 8, the hose 6 and the spigot 5, which are brought into contact with the air, is also high. Therefore, if bacteria are adhered to these portions, they will immediately breed. For this reason, the portions, which are brought into contact with the beverage, must be cleaned frequently. In addition, in a case of beer or the like, tartar is deposited on the inner surface of the cooling pipe and the like. It may be removed from the surface during the pour of the beverage, and mixed in the beverage as contaminant. It is therefore necessary that the interior of the cooling pipe 3 or the like be also cleaned frequently.

However, according to the conventional art, since the cooling pipe 3 and the spigot 5 are integrally incorporated into the cooling and dispensing machine and cannot be removed therefrom, these elements cannot be cleaned easily.

For this reason, in restaurants or the like wherein the machine of this type is used, the cooling pipe 3 and the like are not cleaned frequently in the existing circumstances. In some case, beverage cooling and dispensing machines are collected from the restaurants to a cleaning plant, in which the cooling pipes 3 and the like are completely cleaned and disinfected, and thereafter the machines are returned to the restaurants. In this case, since the overall machine must be moved, considerable labor and cost are required for the moving work. Therefore, it has been necessary that the method of cleaning the cooling pipe 3 be improved.

To solve the above problems, in recent years, various trials have been made to improve the machines. Examples of the improved machines, as shown in FIGS. 4 and 5, will be described. In the following, the same elements as those of the aforementioned conventional art (shown in FIG. 3) are identified with the same reference numerals and detailed description thereof will be omitted. In the machines shown in FIGS. 4 and 5, the dispensing head 8, the hose 6, the cooling pipe 3 and the spigot 5 are integrated as one unit, a beverage pouring unit 210, which is attached to a main body 50 and a beverage tank 7 (FIG. 4). The beverage pouring unit 210 is therefore detachable from the main body 50 (FIG. 5).

With the machine of the improved type, the beverage pouring unit 210 can be removed from the main body 50 of the machine, if necessary, cleaned in the restaurant or the like, or transferred to the cleaning plant and completely cleaned and disinfected therein. Thus, the cleaning operation is greatly simplified.

However, in the above machine of the improved type, an agitator 12 for stirring the cooling water is attached to a supporting plate 20, which is fixed to the upper edge of the water tank, so that agitator 12 is arranged within a coil formed of the cooling pipe 3 (FIG. 5). With this arrangement, when the beverage pouring unit 210 is attached to or detached from the main body 50 of the machine, not only the upper cover 16 but also the supporting plate 20, to which the agitator 12 is attached, must be attached to or detached from the main body simultaneously. A further improvement in the operability has therefore been required.

SUMMARY OF THE INVENTION

As described above, in the conventional machine, the beverage cooling pipe cannot be removed from the main body of the machine. In the machine of the improved type, the beverage cooling pipe, the spigot, the hose, and so on are integrated as one unit, i.e., the beverage pouring unit, which can be removed from the main body. However, when the beverage pouring unit is attached to or detached from the main body, it is necessary that the agitator also be attached to or detached from the main body together with the supporting plate on which the agitator is attached. The operability, therefore, is not necessarily satisfactory.

The present invention has been made in consideration of the above drawbacks of the conventional art. Accordingly, an object of the present invention is to provide a beverage cooling and dispensing machine, which allows the dispensing head, the hose, the cooling pipe, the spigot, and so on, that must be cleaned frequently, to be more easily be attached to or detached from the main body of the machine.

To solve the above problems, according to the present invention, there is provided a beverage cooling and dispensing machine comprising:

a cooling water tank storing cooling water and including an evaporator;

a refrigerator for supplying a coolant to the evaporator;

a cooling pipe through which beverage flows, the cooling pipe being placed within the cooling water tank;

a dispensing head attached to a mouth of a beverage tank filled with beverage;

a hose one end of which is connected to the dispensing head and, and the other end of which is connected to an end of the cooling pipe on a beverage introducing side;

a spigot connected to the end of the cooling pipe on the beverage extracting side; and an agitator, placed in the cooling water tank, for stirring the cooling water, wherein the dispensing head, the hose, the cooling pipe and the spigot are integrated as one unit, constituting a beverage pouring unit, which is detachably attached to the cooling water tank, and the agitator is supported by supporting legs fixed to the bottom of the cooling water tank.

With the beverage cooling and dispensing machine of the present invention, the dispensing head, the hose, the joint, the cooling pipe and the spigot are integrated as one unit, constituting a beverage pouring unit. In addition, the agitator for stirring the cooling water is supported by the supporting legs fixed to the bottom of the cooling water tank. With this structure, the beverage pouring unit is completely removable from the beverage tank and the main body. Moreover, attachment or detachment of the beverage pouring unit can be performed without removing the agitator. In this manner, the operability of the cooling and dispensing machine is improved, so that the beverage pouring unit can be cleaned and disinfected much more easily. Consequently, the taste of the beverage will not be spoiled.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

An embodiment of the present invention will be described with reference to FIGS. 1 and 2.

Figure 1:
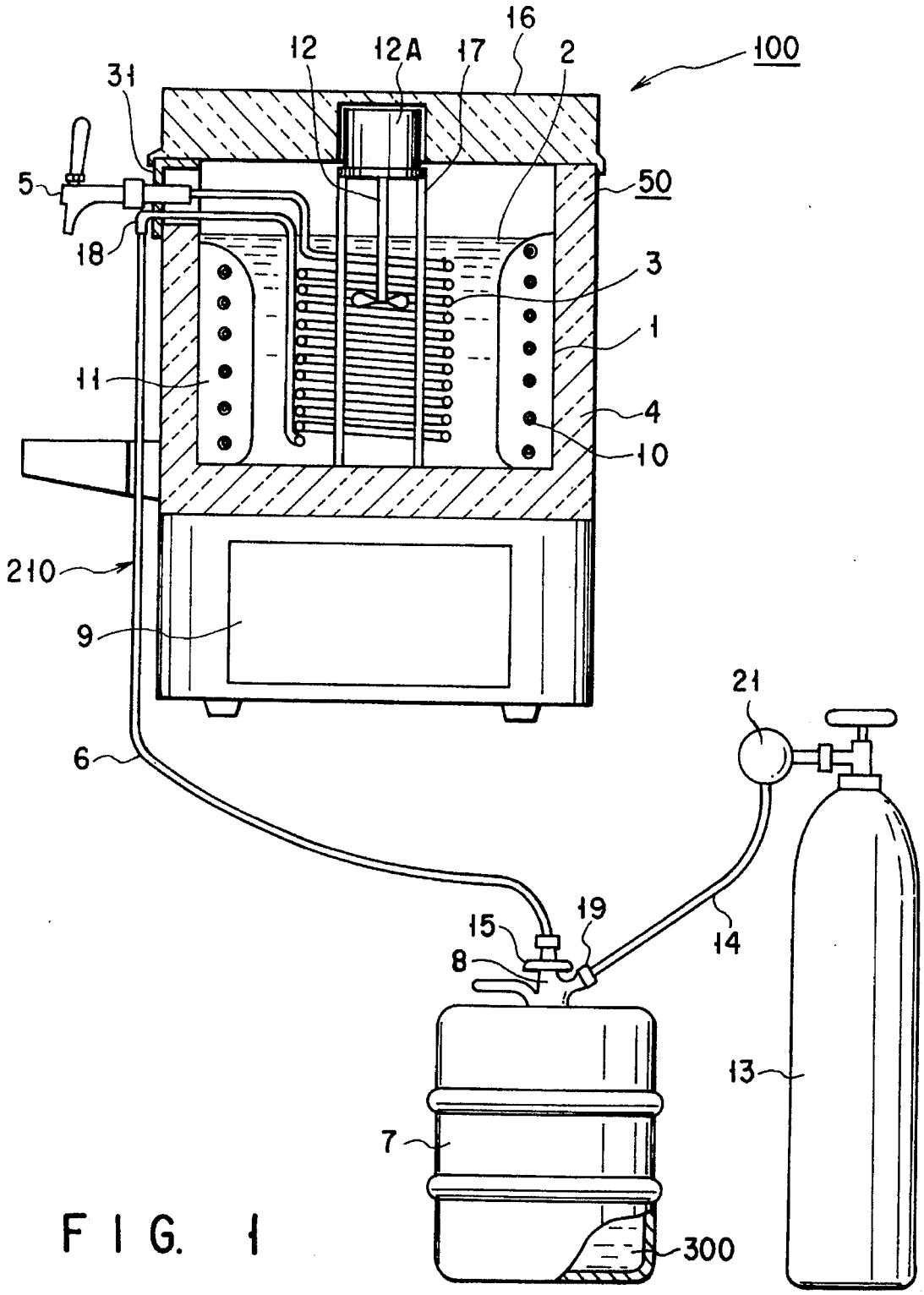
FIG. 1 is a cross-sectional view of a beverage cooling and dispensing machine according to an embodiment of the present invention.

FIG. 1 is a cross-sectional view showing a beverage cooling and dispensing machine 100 in use according to the present invention. FIG. 2 is a cross-sectional view of the beverage cooling and dispensing machine 100, from which a beverage pouring unit 210 is removed.

The beverage cooling and dispensing machine 100 of the present invention has the following structure. A main body 50 of the machine has a cooling water tank 1, which is filled with cooling water 2. An evaporator 10 is provided along the inner wall of the cooling water tank 1 and connected to a refrigerator 9 arranged below the main body 50. When the refrigerator 9 is operated, the cooling water 2 is cooled by latent heat of vaporization of a coolant flowing inside the evaporator 10. Part of the cooling water is frozen, so that ice 11 is adhered to the inner wall of the evaporator 10. The amount of ice 11 is controlled to be substantially constant.

A coiled cooling pipe 3 is immersed in the cooling water 2 in the cooling water tank 1. The wall of the cooling water tank 1 is formed of heat insulating material 4. A cutout portion 30 is formed in an upper end of the heat insulating material 4. An attachment plate 31 is attached to the cutout portion 30 so as to close the cutout. A spigot 5 for pouring the beverage out of the cooling water tank 1 and a joint 18 for introducing the beverage into the cooling water tank 1 are attached to the attachment plate 31. The spigot 5 is connected to one end of the cooling pipe 3 and the joint 18 is connected to the other end thereof. A hose 6 is connected to an end of the joint 18 which is located outside the cooling water tank 1. An upstream end of the hose 6 is connected to a dispensing head 8 of a beverage tank 7, i.e., a beverage supply source.

Figure 2:
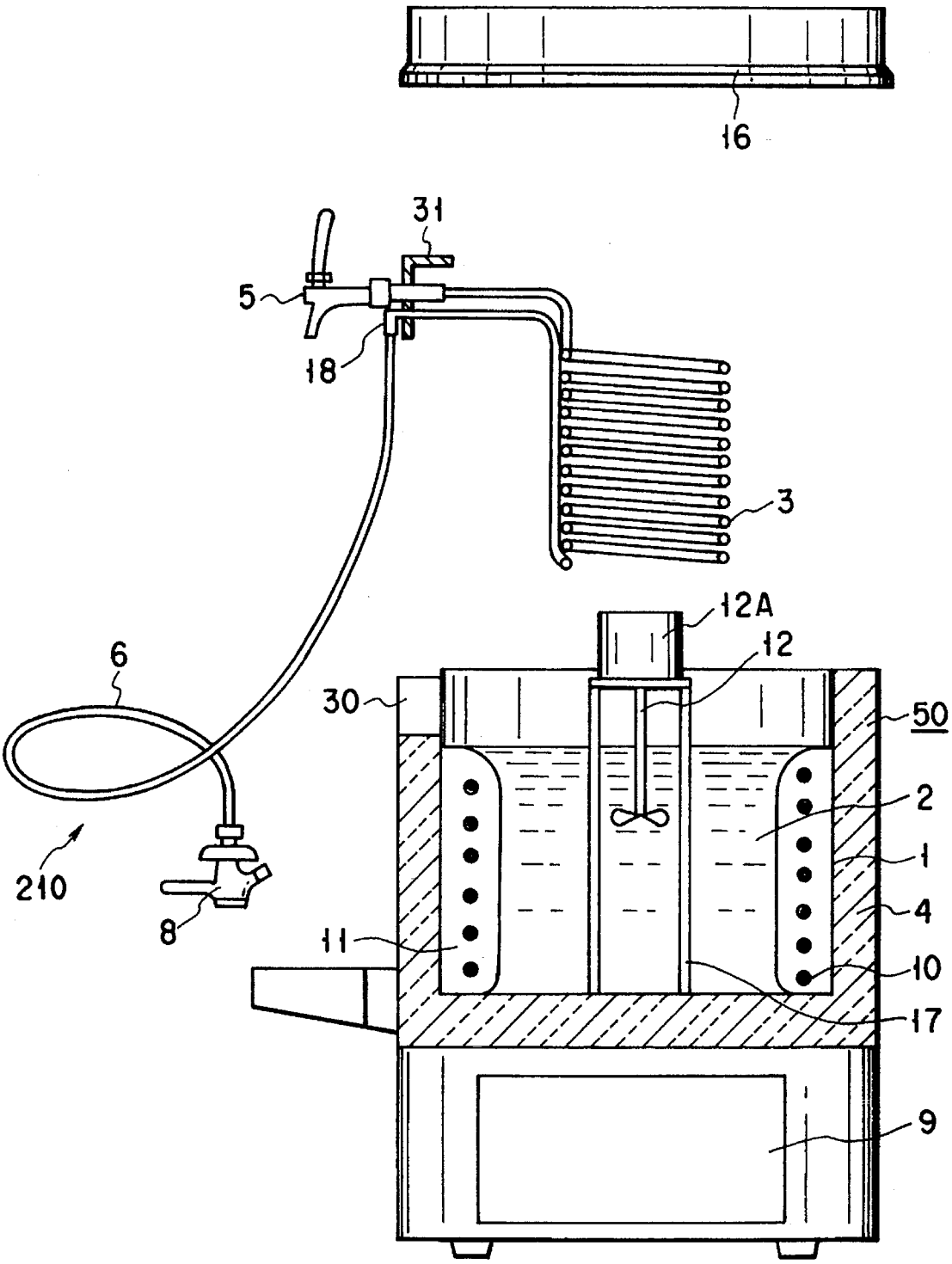
FIG. 2 is a cross-sectional view of the beverage cooling and dispensing machine shown in FIG. 1, from which a beverage pouring unit is removed.
Figure 3:
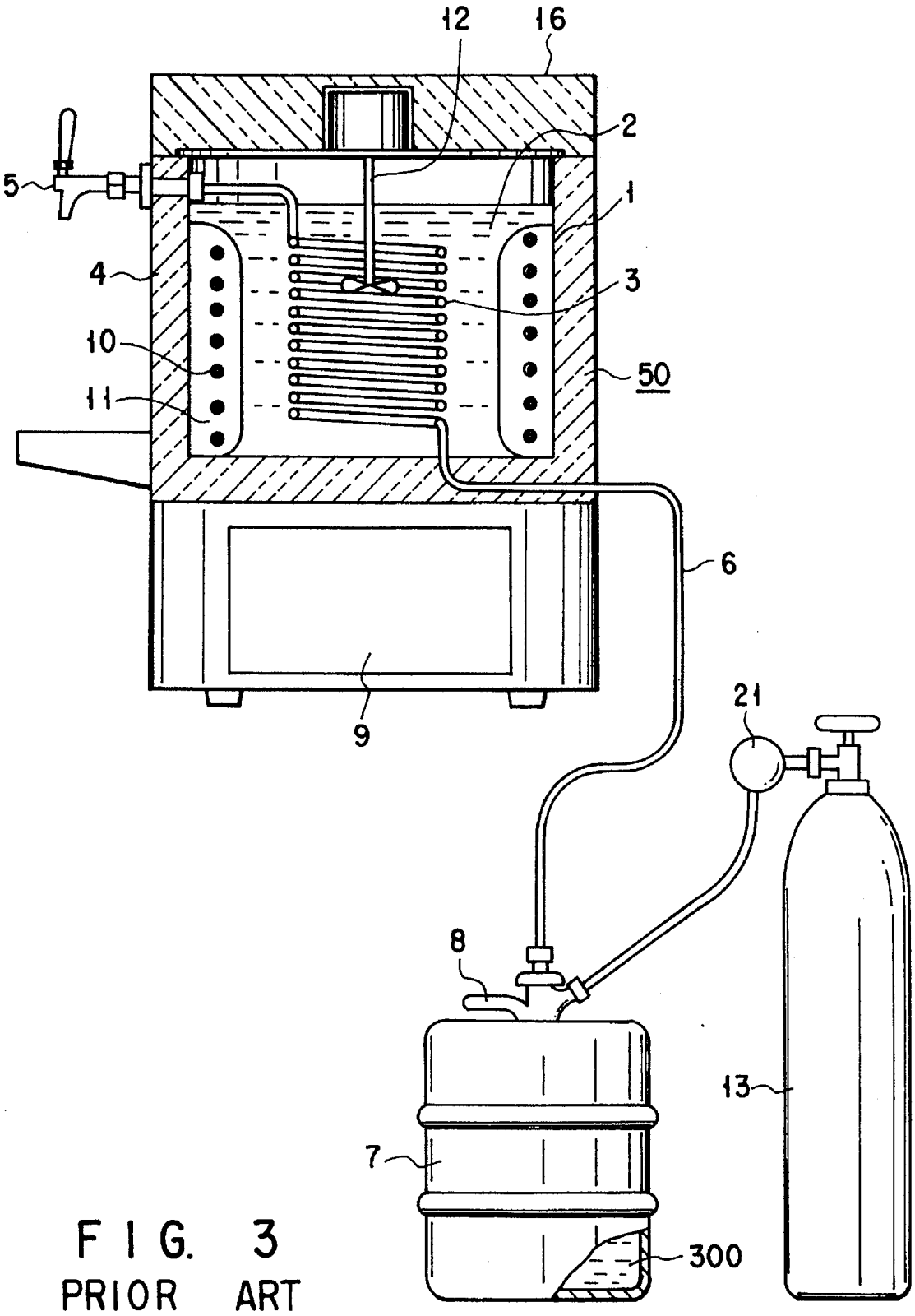
FIG. 3 PRIOR ART
FIG. 3 is a cross-sectional view of the conventional beverage cooling and dispensing machine in use.
Figure 4:
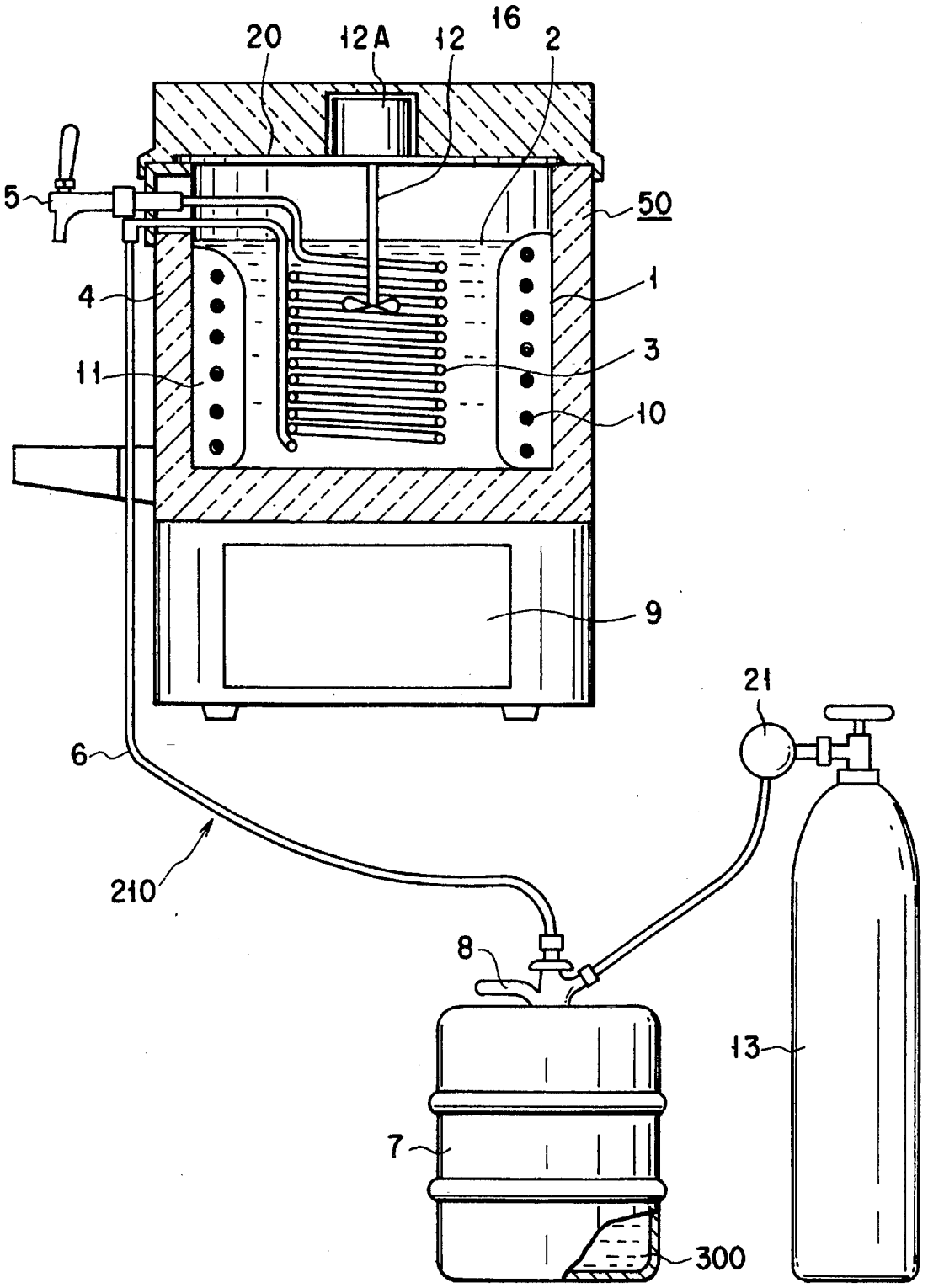
FIG. 4 PRIOR ART
FIG. 4 is a cross-sectional view of the improved conventional beverage cooling and dispensing machine in use.
Figure 5:
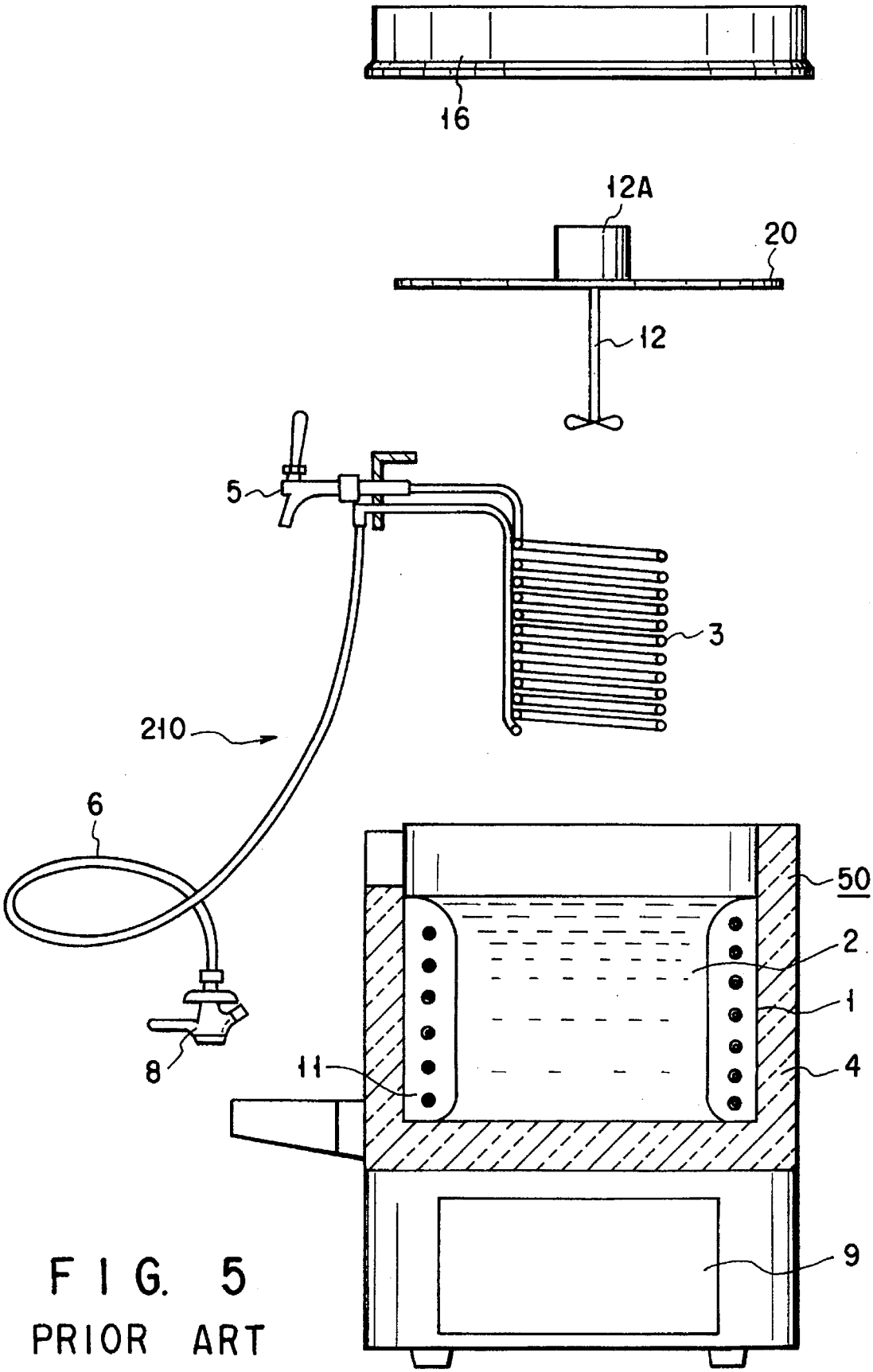
FIG. 5 PRIOR ART
FIG. 5 is a cross-sectional view of the improved conventional beverage cooling and dispensing machine, from which a beverage pouring unit is removed.

The dispensing head 8, the hose 6, the joint 18, the cooling pipe 3 and the spigot 5, which constitute a beverage flowing path, are integrated into one unit together with the attachment plate 31, as shown in FIG. 2. The unit is referred to as a beverage pouring unit 210.

Further, an agitator 12 is arranged inside the coil made of the cooling pipe 3 in order to stir the cooling water 2, so that the beverage flowing through the cooling pipe 3 can be efficiently cooled. A blade portion of the agitator 12 has a rotational diameter smaller than the inner diameter of the coil made of the cooling pipe 3. A motor portion 12A of the agitator, arranged above the surface of the cooling water 2, is supported by supporting legs 17 fixed to the bottom of the cooling water tank 1.

With the machine as described above, when a beverage 300 stored in the beverage tank 7 is to be taken out, the dispensing head 8 is first attached to the mouth of the beverage tank 7. The dispensing head 8 has a joint 19 for introducing gas into the tank. One end of a gas hose 14 is connected to a reducing valve 21 attached on a carbon dioxide gas cylinder 13 and the other end thereof is connected to the joint 19. Then, when a handle 15 of the dispensing head 8 is operated to opening direction, a gas valve (not shown) held in the mouth of the beverage tank 7 is opened. At the same time, a beverage valve (not shown) held in the mouth of the beverage tank 7 is also opened. As a result, a pressure of the carbon dioxide gas which is regulated with the reducing valve 21 is applied into the beverage tank 7, thereby guiding the beverage 300 to the spigot 5 for dispensing the beverage through a inductor tube (not shown) arranged in the beverage tank 7, the dispensing head 8, the hose 6, the joint 18 and the cooling pipe 3 in this order.

When the spigot 5 for dispensing the beverage is opened, the beverage 300 in the beverage tank 7 is passed through the cooling pipe 3 by the pressure of the carbon dioxide gas and is poured out through the spigot 5. While the beverage is passing through the cooling pipe 3, the beverage exchanges heat with the cooling water 2 and is immediately cooled. Thus, the cooled beverage is dispensed.

In the above embodiment, the beverage pouring unit 210 is attachable to and detachable from the main body in the following manner. First, the gas hose 14 is detached from the joint 19 for introducing gas, and the dispensing head 8 is removed from the beverage tank 7. Then, the upper cover 16 of the cooling water tank 1 is removed and the cooling pipe 3 is drawn up from the cooling water tank 1. At this time, the wiring line of the agitator connected to the motor portion 12A is drawn through the inside of the coiled cooling pipe 3, without detaching the wiring line from the motor portion. It is possible that a connector is provided near the motor portion 12A, so that the wiring line can be removed from the motor portion 12A. Further, it is possible that the agitator 12 is detached from the supporting leg 17.

As has been described above, according to the beverage cooling and dispensing machine of the present invention, the dispensing head 8, the hose 6, the joint 18, the cooling pipe 3 and the spigot 5 are integrated into one, the beverage pouring unit 210. In addition, the agitator 12 for stirring the cooling water 2 is supported by the supporting legs 17 fixed to the bottom of the cooling water tank 1. As a result, the beverage pouring unit 210 is completely removable from the beverage tank 7 and the main body 50. Moreover, the beverage pouring unit 210 can be attached to or detached from the main body without removing the agitator 12. In this manner, the operability of the cooling and dispensing machine is improved, so that the beverage pouring unit 210 can be cleaned and disinfected much more easily. Consequently, the taste of the beverage will not be spoiled.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A beverage cooling and dispensing machine comprising:

a cooling water tank for storing cooing water and including an evaporator;

a refrigerator for supplying a coolant to the evaporator;

a cooling pipe through which beverage may flow, the cooling pipe being in the form of a coil and being placed within the cooling water tank;

a dispensing head attachable to a mouth of a beverage tank filled with beverage;

a hose, one end of which is connected to the dispensing head and, and the other end of which is connected to an end of the cooling pipe on a beverage introducing side thereof;

a spigot connected to the end of the cooling pipe on the beverage extracting side thereof; and an agitator for stirring the cooling water, the agitator including a blade portion, a motor portion and supporting members supporting said motor portion, said blade portion being disposed inside the coil formed by the cooling pipe, said motor being disposed above a surface of the cooling water and being supported by said supporting members, said supporting members being fixed to a bottom of the cooling water tank, wherein the dispensing head, the hose, the cooling pipe and the spigot are integrated as one unit, constituting a beverage pouring unit, which is detachably attached to the cooling water tank.

2. The beverage cooling and dispensing machine according to claim 1, wherein:

a cutout portion is formed in an upper edge of the cooling water tank; and an attachment plate is attached to the cutout portion and the spigot and the hose are inserted through the attachment plate.

* * * * *